US006339405B1

(12) United States Patent
Gleener

(10) Patent No.: US 6,339,405 B1
(45) Date of Patent: Jan. 15, 2002

(54) DUAL BAND DIPOLE ANTENNA STRUCTURE

(75) Inventor: Andrey Gleener, Burnaby (CA)

(73) Assignee: Sierra Wireless, Inc., Richmond (CA)

( * ) Notice: Subject to any disclaimer, the term of this patent is extended or adjusted under 35 U.S.C. 154(b) by 0 days.

(21) Appl. No.: 09/864,613

(22) Filed: May 23, 2001

(51) Int. Cl.[7] ..... H01Q 9/28

(52) U.S. Cl. ..... 343/795; 343/700 MS; 343/821

(58) Field of Search ..... 343/700 MS, 795, 343/810, 816, 820, 821, 822, 853, 893; H01Q 1/24, 9/16, 9/28

(56) References Cited

U.S. PATENT DOCUMENTS 4,823,144 A * 4/1989 Guy ..... 343/853
5,285,212 A * 2/1994 McNiece ..... 343/795
5,867,130 A * 2/1999 Tay et al. ..... 343/795
5,949,383 A * 9/1999 Hayes et al. ..... 343/795
6,005,522 A * 12/1999 Arias et al. ..... 343/700 MS
6,072,439 A * 6/2000 Ippolito et al. ..... 343/797
6,163,306 A * 12/2000 Nakamura et al. ..... 343/797

* cited by examiner

*Primary Examiner*—Tho G. Phan
(74) *Attorney, Agent, or Firm*—Burns Doane Swecker & Mathis LLP

(57) ABSTRACT

A dual band antenna structure for transmission electromagnetic energy in two frequency bands. The antenna structure has a substrate with a first side having a first dipole radiating element and a second dipole radiating element. The lengths of the dipole radiating elements are chosen to transmit the first and second frequencies. The antenna structure further includes a first dipole ground disposed in substantially mirror-image relation to the first dipole radiating element and a second dipole ground disposed in substantially mirror-image relation to the second dipole radiating element. The first and second dipole radiating elements are electrically connected to a transformer formed on the first side of the substrate. Electromagnetic energy fed to the transformer in the first frequency band is transmitted by the first dipole radiating element while electromagnetic energy fed to the transformer in the second frequency band is transmitted by the second dipole radiating element.

32 Claims, 1 Drawing Sheet

DUAL BAND DIPOLE ANTENNA STRUCTURE

FIELD OF THE INVENTION

The present invention generally relates to dipole antenna structures and more particulary to a dual band dipole antenna structure operative to efficiently transmit radio frequency (RF) energy at two different frequencies.

BACKGROUND OF THE INVENTION

In order to efficiently operate, the length of a dipole antenna is typically related to the operating frequency thereof. The length of the dipole element is a multiple of the frequency to be transmitted or received. For example, the dipole element may have a length that is ¼, ½, or ¾ the wavelength of transmission. As will be recognized, a single dipole element cannot efficiently operate for multiple operating frequencies because the length thereof must change.

For instance, in wireless technology, the device may need to operate on two different frequency bands. The device may have an operating frequency of either 800 MHZ or 1900 MHZ depending upon the type of service the wireless device is accessing. As such, the antenna structure must be capable of efficient transmission and reception of RF energy at both of those bands.

Printed antenna structures are widely used to provide compact antennas for portable devices. The printed antenna structures are typically formed on a substrate such as a PCB by forming conductive traces on the PCB. In this regard, the printed antenna structure can be integrated with other electronic devices on the substrate. Typically, the antenna structure is designed on a rigid PCB having a thickness of about 3–5 mm. Therefore, the size and thickness of the PCB restrict the size of the device that the antenna can be placed within. Typically, in portable wireless devices (i.e., cellular telephones), the housing for the device is designed around the size of the antenna structure.

In order to efficiently transmit over both frequency bands, printed antenna structures have been designed with complicated wire patterns in order to provide the correct dipole length. For instance, in U.S. Pat. No. 5,949,383 to Hayes et al. entitled "Compact Antenna Structures Including Baluns", the printed antenna structure includes multiple radiating sections and a balun in order to tune the antenna for two operating frequencies. The printed antenna structure further includes a tunning shunt across the balun in order to provide dual band operation. In this sense, the printed antenna structure includes a complicated trace structure and tunning mechanism to provide dual band operation.

The present invention addresses the above-mentioned deficiencies in the prior art antenna structures by providing a dipole antenna structure that is compact in size and easily formed. More specifically, the present invention provides an antenna structure that is formed on a thin film PCB and comprises two dipole elements and corresponding dipole grounds. In this sense, the design of the antenna structure for the present invention provides for dual band operation with a compact and easily fabricated structure.

SUMMARY OF THE INVENTION

In accordance with the present invention, there is provided a dual band antenna structure having a substrate with first and second sides. The first side includes a first dipole element, and a second dipole element formed in substantially parallel relation to the first dipole element and electrically connected thereto. The first side of the antenna further includes a generally wedged shaped transformer electrically connected to the first and second dipole elements. The second side of the antenna structure includes a first dipole ground disposed in generally opposite relation to the first dipole element and a second dipole ground disposed in generally opposite relation to the second dipole element. The first and second dipole grounds are electrically connected together via a ground line. Accordingly, RF energy fed into the transformer can be transmitted at a first frequency by the first dipole element and can be transmitted at a second frequency by the second dipole element.

In accordance with the present invention, the first dipole element has a length equal to about ¼ the wavelength of the first frequency and the second dipole element has a length equal to about ¼ the length of the second frequency. The first dipole ground has a length equal to about ¼ the wavelength of the first frequency, while the second dipole ground has a length equal to about ¼ the length of the second frequency. Both the first and second dipole elements are disposed in substantially parallel relation to the transformer element.

In the preferred embodiment, the shape of the first dipole ground is substantially similar to the shape of the first dipole element, while the shape of the second dipole ground is substantially similar to the shape of the second dipole element. In this respect, both the first dipole element and the second dipole radiating element are substantially rectangular. The first and second dipole grounds are disposed in opposite relation on the second side of the substrate in substantially mirror-image relation to respective first and second dipole elements.

In accordance with the present invention, the substrate is a thin film such as a thin film PCB. The thin film may additionally be flexible. The first and second dipole elements are formed as conductive tracings on the PCB through conventional techniques. A microstrip is formed as the ground line connecting the first and second dipole grounds, as well as to connect the first dipole element, the second dipole element and the transformer.

In accordance with the present invention, there is provided a dual band antenna structure having a substrate, a first antenna array, a second antenna array, and a transformer. The first antenna array has a first dipole element disposed on a first side of the substrate. Furthermore, the first antenna array has a first dipole ground disposed on a second side of the substrate. The first dipole ground is disposed in substantially mirror-image relationship to the first dipole element. The second antenna array has a second dipole element disposed on the first side of the substrate and a second dipole ground disposed on the second side of the substrate. The second dipole ground is disposed in substantially mirror-image relationship to the first dipole element. The transformer is formed on the first side of the substrate and electrically connects the first and second dipole elements. In this respect, the first array is operative to transmit electromagnetic energy at a first frequency and the second array is operative to transmit electromagnetic energy at a second frequency when the electromagnetic energy is fed to the transformer. The length of the first dipole element is chosen to transmit the first frequency and the length of the second dipole element is chosen to transmit the second frequency.

In accordance with the present invention, there is provided a method of forming a dual band antenna structure for transmitting a first and a second frequency. The method comprises providing a thin film substrate having a first side and a second side. Next a first dipole element is formed on the first side of the substrate. A first dipole ground is formed on the second side of the substrate in substantially mirror-image relation to the first dipole element. A second dipole element is formed on the first side of the substrate and a second dipole ground is formed on the second side of the substrate in substantially mirror-image relation to the second dipole element. Finally a transformer is formed on the first side of the substrate. The transformer is electrically connected to the first dipole element and the second dipole radiating element.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
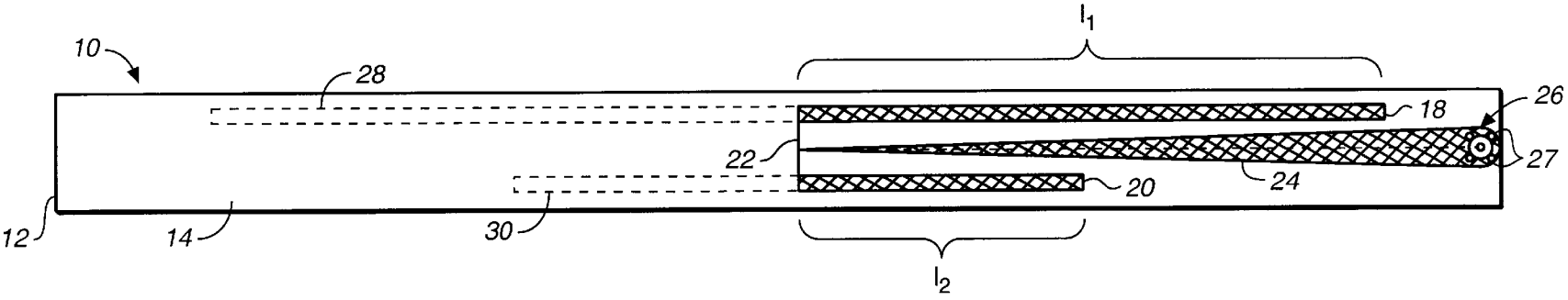
FIG. 1 is a plan view of a first side of a dual band antenna structure constructed in accordance with the present invention.
Figure 2:
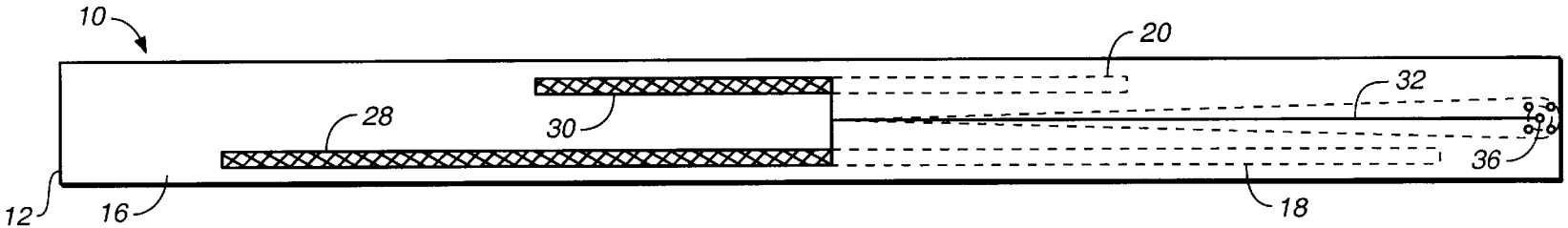
FIG. 2 is a plan view of a second side of the antenna structure shown in FIG. 1.

Referring now to the drawings wherein the showings are for purposes of illustrating a preferred embodiment of the present invention only, and not for purposes of limiting the same, FIG. 1 is a plan view of an antenna structure 10. Specifically, the antenna structure 10 has a non-conductive substrate 12 with conductive tracings formed thereon. The substrate 12 has a first side 14 as seen in FIG. 1, and a second side 16 as seen in FIG. 2. In the preferred embodiment of the present invention, the substrate 12 is a thin film, flexible printed circuit board (PCB) with a cross-sectional thickness of about 0.5 mm. The conductive tracings are formed on the PCB substrate 12 through conventional techniques such as photo-etching.

Referring to FIG. 1, the substrate 12 has a first dipole element 18 formed on the first side 14 thereof. The first dipole element 18 is formed from a conductive material such as copper on the first side 14 of the substrate 12. The first dipole element 18 is generally rectangular and has a length $l_1$ equal to about ¼ the wavelength of the lowest frequency that the antenna structure 10 is designed for. Similarly, the antenna structure 10 includes a second dipole element 20 formed on the first side 14 of the substrate 12. The second dipole element 20 is generally rectangular and has a length $l_2$ that is equal to about ¼ the wavelength of the highest frequency that the antenna structure is designed for. Accordingly, the first dipole element 18 is designed to transmit and receive electromagnetic radiation in a first frequency bandwidth, while the second dipole element is designed to transmit and receive electromagnetic radiation in a second frequency bandwidth. For the antenna structure 10 depicted in FIGS. 1 and 2, the first dipole element 18 is designed to transmit frequencies in a band that is lower than the second dipole element 20 thereby providing for dual band operation.

Referring to FIG. 1, the antenna structure 10 further includes a microstrip 22 electrically connecting the first dipole element 18 to the second dipole element 20. Specifically, the microstrip 22 is a conductive material such as copper formed on the first side 14 of the substrate 12 and connecting the same ends of respective first and second dipole elements 12, 14. The microstrip 22 functions to end feed the first and second dipole elements 18, 20, as will be further explained below. The microstrip 22 is electrically connected to a generally wedged-shaped transformer 24 formed on the first side 14 of the substrate 12. The transformer 24 is formed from a conductive material such as copper and has a connecting portion 26 wherein a conductor from a transceiver is connected. Specifically, the connecting portion 26 is adapted to be electrically attached to the transceiver such that electromagnetic energy to be transmitted by the antenna structure 10 is fed to the transformer 24 and electromagnetic energy received by the antenna structure 10 is fed from the transformer 24 at the connecting portion 26 to the transceiver. The connecting portion 26 has four outer apertures 27 for soldering a wire thereto. The outer circumference of each of the apertures 27 is in contact with the transformer 24 at the connecting portion 26. In this respect, a conductor soldered into each of the outer apertures 27 would be electrically connected to the transformer 24.

As seen in FIG. 1, the transformer 24 tapers from the connecting portion 26 to the microstrip 22. In this regard, the taper of the transformer 24 is operative to provide impedance matching as is currently known in the art between the transceiver and the first and second dipole elements 18, 20 attached to the transformer 24 via microstrip 22. The transformer 24 and microstrip 22 provide a method of end feeding electromagnetic energy to the first and second dipole elements 18, 20.

Referring to FIG. 2, the antenna structure 10 further includes a first dipole ground 28 disposed on the second side 16 of the substrate 12. Specifically, the first dipole ground 28 is formed from a conductive material such as copper on the second side 16 of the substrate 12. The shape of the first dipole ground 28 is substantially similar as the first dipole element 18. In this respect, the first dipole ground 28 is generally rectangular and has length $l_1$. Furthermore, as seen in FIGS. 1 and 2, the first dipole ground 28 is disposed in a generally mirror-image relationship to the first dipole element 18. Specifically, the first dipole ground 28 is in mirror-image relation to the first dipole element 18 about axis "A". In this regard, the first dipole ground 28 is formed as if the first dipole element were rotated about axis "A" and placed on the second side 16 of substrate 12.

Referring to FIG. 2, the antenna structure 10 further includes a second dipole ground 30 formed on the second side 16 of the substrate 12. The second dipole ground 30 is formed as a mirror-image of the second dipole element 20 rotated around axis "A". The shape of the second dipole ground 30 is substantially similar to the shape of the second dipole element 20. In this respect, the second dipole ground 30 has a length of $l_2$ and is generally rectangularly shaped.

The antenna structure 10 further includes a generally T-shaped ground line 32 electrically connected to the ends of both of the first and second dipole grounds 28, 30. As seen in FIG. 2, the ground line 32 extends from the ends of each of the dipole grounds 28, 30 to a "T" junction and then extends to the connecting portion 26. Specifically, the ground line 32 extends to an inner aperture 36 of the connecting portion 26. The outer circumference of the inner aperture 36 is in electrical contact with the ground line 32 such that a conductor soldered into the inner aperture 36 will be electrically connected to the ground line 32 and hence first and second dipole grounds 28, 30. Typically, a ground of the transceiver is attached to the inner aperture 36.

In accordance with the present invention, the combination of the first dipole element 18 and the first dipole ground 28 define a first antenna array 38. Similarly, the second dipole element 20 and second dipole ground 30 define a second antenna array 40. The first antenna array 38 is operative to transmit and receive signals in a first frequency bandwidth corresponding to the length of the first dipole element 18. The second antenna array 40 is operative to transmit and receive signals in a second frequency bandwidth corresponding to the length of the second dipole element 28. In this respect, the combination of the first and second antenna arrays 38, 40 are operative to transmit and receive electromagnetic energy within two distinct bandwidths.

Additional modifications and improvements of the present invention may also be apparent to those of ordinary skill in the art. Thus, the particular combination of parts described and illustrated herein is intended to represent only a certain embodiment of the present invention only, and is not intended to serve as a limitation of alternative devices within the spirit and scope of the invention.

What is claimed is:

1. An antenna structure comprising:

a substrate having a first side and a second side;

the first side having:

a first dipole element;

a second dipole element formed in substantially parallel relation to the first dipole element and electrically connected thereto; and a generally wedged shaped transformer electrically connected to the first and second dipole elements; and the second side having:

a first dipole ground disposed in generally opposite relation to the first dipole element;

a second dipole ground disposed in generally opposite relation to the second dipole element, the second dipole ground electrically connected to the first dipole ground; and a ground line electrically connected to the first dipole ground and the second dipole ground;

wherein RF energy is fed into the transformer such that the RF energy can be transmitted at a first frequency with the first dipole element and a second frequency with the second dipole element.

2. The antenna structure of claim 1 wherein the first dipole element has a length equal to about ¼ the wavelength of the first frequency and the second dipole element has a length equal to about ¼ the wavelength of the second frequency.

3. The antenna structure of claim 2 wherein the first dipole ground has a length equal to about ¼ the wavelength of the first frequency and the second dipole ground has a length equal to about ¼ the wavelength of the second frequency.

4. The antenna structure of claim 3 wherein the first dipole element and the second dipole element are disposed in substantially parallel relation to the transformer.

5. The antenna structure of claim 4 wherein the shape of the first dipole ground is substantially similar to the shape of the first dipole element, and the shape of the second dipole ground is substantially similar to the shape of the second dipole element.

6. The antenna structure of claim 5 wherein the first dipole element and the second dipole element are generally rectangular.

7. The antenna structure of claim 6 wherein the first and second dipole grounds are disposed in a generally mirror-image relationship to respective first and second dipole elements.

8. The antenna structure of claim 1 wherein the substrate is a thin film.

9. The antenna structure of claim 8 wherein the thin film is a thin film printed circuit board (PCB).

10. The antenna structure of claim 9 wherein the thin film PCB is flexible.

11. The antenna structure of claim 10 wherein the first and second dipole elements and the first and second dipole grounds are conductive traces on the PCB.

12. The antenna structure of claim 11 further comprising a microstrip electrically connecting the first dipole element, the second dipole element and the transformer.

13. The antenna structure of claim 12 wherein the ground line is a microstrip formed on the substrate.

14. A dual band antenna structure comprising:

a substrate;

a first antenna array having:

a first dipole element disposed on a first side of the substrate; and a first dipole ground disposed on a second side of the substrate, the first dipole ground being disposed in substantially mirror-image relationship to the first dipole element; and a second antenna array having:

a second dipole element disposed on the first side of the substrate; and a second dipole ground disposed on the second side of the substrate, the second dipole ground being disposed in substantially mirror-image relationship to the second dipole element; and a transformer formed on the first side of the substrate and electrically connected to the first and second dipole elements;

wherein the first array is operative to transmit electromagnetic energy at a first frequency and the second array is operative to transmit electromagnetic energy at a second frequency when the electromagnetic energy is fed to the transformer.

15. The antenna structure of claim 14 wherein the first dipole element has a length equal to about ¼ the wavelength of the first frequency and the second dipole element has a length equal to about ¼ the wavelength of the second frequency.

16. The antenna structure of claim 15 wherein the first dipole ground has a length equal to about ¼ the wavelength of the first frequency and the second dipole ground has a length equal to about ¼ the wavelength of the second frequency.

17. The antenna structure of claim 16 wherein the first antenna array is disposed in substantially parallel relation to the second antenna array.

18. The antenna structure of claim 17 wherein the transformer is disposed in substantially parallel relation to the first antenna array and the second antenna array.

19. The antenna structure of claim 18 wherein the shape of the first dipole element is substantially identical to the shape of the first dipole ground, and the shape of the second dipole element is substantially identical to the shape of the second dipole ground.

20. The antenna structure of claim 19 wherein the first dipole element and the second dipole element are generally rectangular.

21. The antenna structure of claim 14 wherein the substrate is a thin film.

22. The antenna structure of claim 21 wherein the thin film is a thin film PCB.

23. The antenna structure of claim 22 wherein the thin film PCB is flexible.

24. The antenna structure of claim 23 wherein the first and second dipole elements and the first and second dipole grounds are conductive traces formed on the PCB.

25. The antenna structure of claim 24 further comprising a microstrip electrically connecting the first dipole element, the second dipole element and the transformer.

26. A method of forming a dual band antenna structure for transmitting a first and a second frequency, the method comprising the steps of:

a) providing a thin film substrate having a first side and a second side;

b) forming a first dipole element on the first side of the substrate;

c) forming a first dipole ground on the second side of the substrate, the first dipole ground being formed in substantially mirror-image relation to the first dipole element;

d) forming a second dipole element on the first side of the substrate;

e) forming a second dipole ground on the second side of the substrate, the second dipole ground being formed in substantially mirror-image relation to the second dipole element; and f) forming a transformer on the first side of the substrate, the transformer being formed to be electrically connected to the first dipole element and the second dipole element in order to transmit at the first and second frequencies.

27. The method of claim 26 further comprising the step of forming a ground line on the second side of the substrate, the ground line being formed to be electrically connected to the first dipole ground and the second dipole ground.

28. The method of claim 27 wherein step (a) comprises providing a thin film PCB as the substrate.

29. The method of claim 28 wherein the first dipole element, the second dipole element, the first dipole ground and the second dipole ground are formed with conductive traces on the substrate.

30. The method of claim 29 wherein step (b) comprises forming the first dipole element having a length equal to about ¼ the wavelength of the first frequency, and step (c) comprises forming the second dipole element having a length equal to about ¼ the wavelength of the second frequency.

31. The method of claim 30 wherein step (d) comprises forming the first dipole ground that is substantially identical to the first dipole element, and step (e) comprises forming the second dipole ground substantially identical to the second dipole element.

32. The method of claim 31 wherein the first dipole element and the second dipole element are formed generally rectangular.

* * * * *

UNITED STATES PATENT AND TRADEMARK OFFICE

CERTIFICATE OF CORRECTION

PATENT NO. : 6,339,405 B1
APPLICATION NO. : 09/864613
DATED : January 15, 2002
INVENTOR(S) : Audrey Gleener It is certified that error appears in the above-identified patent and that said Letters Patent is hereby corrected as shown below:

Column 1, Lines 22 and 23: In two places “MHZ” should be “MHz”
Column 1, Line 48: “tunning” should be “tuning”
Column 1, Line 49: “tunning” should be “tuning”
Column 8, Lines 10 and 14: “1/4 the length” should be “1/4 the wavelength”

Signed and Sealed this
Twenty-eighth Day of August, 2012

David J. Kappos

David J. Kappos
*Director of the United States Patent and Trademark Office*